US005154458A

United States Patent [19]

Cook et al.

[11] Patent Number: 5,154,458

[45] Date of Patent: Oct. 13, 1992

[54] SECURITY DEVICE FOR CARGO DOORS AND SIMILAR ARTICLES

[75] Inventors: Jonathan J. Cook; Michael N. Bruno, both of South Bend, Ind.

[73] Assignee: International Trade & Technologies, Inc., South Bend, Ind.

[21] Appl. No.: 843,635

[22] Filed: Feb. 28, 1992

[51] Int. Cl.[5] ..... E05C 9/08; E05B 67/38

[52] U.S. Cl. ..... 292/218; 70/417; 292/205

[58] Field of Search ..... 292/104, 148, 205, 218, 292/DIG. 32; 70/54-56, 417

[56] References Cited

U.S. PATENT DOCUMENTS

| | | | |
|---|---|---|---|
| 3,871,694 | 3/1975 | White | 292/218 |
| 4,031,719 | 6/1977 | Klingler et al. | 292/148 X |
| 4,898,008 | 2/1990 | Eberly | 70/417 X |
| 4,911,486 | 3/1990 | Anderson | 292/145 |

*Primary Examiner*—Richard E. Moore
*Attorney, Agent, or Firm*—Barnes & Thornburg

[57] ABSTRACT

A security device for cargo doors and similar articles which utilizes a conventional padlock to secure the horizontally extending handle present on many conventional double cargo doors of cargo carrying vehicles. The security device includes a stationary base member which is mounted on the cargo door by carriage bolts or other conventional fasteners and a rotatable blocking member which is rotatably mounted on the cargo door above the stationary base member. The rotatable blocking member can be rotated in a plane parallel to the cargo door upwardly in relation to the stationary base member to allow the horizontally extending handle to be placed adjacent the stationary base member. Once the horizontally extending handle is placed in this position, the rotatable blocking member is rotated to a position adjacent the stationary base member and a conventional padlock is used to lock rotatable blocking member and stationary base member together thereby securing the horizontally extending handle between the cargo door and the security device. Thus, further movement of the horizontally extending handle is precluded until the padlock is removed and the rotatable blocking member pivoted to a position away from the stationary base member.

16 Claims, 3 Drawing Sheets

SECURITY DEVICE FOR CARGO DOORS AND SIMILAR ARTICLES

BACKGROUND AND SUMMARY OF THE INVENTION

The present invention relates generally to new and novel security devices for cargo doors and similar articles. More particularly, the present invention relates to security devices which secure the doors of cargo carrying vehicles, thus, precluding access by unauthorized individuals.

The concept of utilizing a security device to preclude access to cargo present in a cargo carrying vehicle or similar article is well-known. Examples of such devices are shown in U.S. Pat. No. 4,581,907 to Eberly and U.S. Pat. No. 4,895,007 to Eberly. However, many of the prior art security devices cannot be mounted and used in conjunction with the conventional double doors present on many cargo carrying vehicles. Also, the shackle of the securing padlock is often not adequately protected from unauthorized removal by hammers, bolt cutters, hacksaws, pry bars and other tampering devices Once the padlock is so removed, such security devices are rendered inoperative. Furthermore, many of the prior art security devices are large and cumbersome to use. Such devices would be relatively expensive to produce because of the mass of material necessary to fabricate these devices, as well as the complexity of the geometry of individual pieces.

A further disadvantage of many prior art security devices is that the fasteners used to attach the security device to the cargo door often extend a significant distance beyond the interior of the cargo door into the cargo carrying space. This inwardly extending portion not only decreases the volume of cargo carrying space available, but may also penetrate, scratch or otherwise damage the cargo present, particularly when the cargo door is closed on a full load, or when the cargo shifts against the cargo door during transportation.

Another drawback of prior art security device fastening arrangements is that the fasteners are often susceptible to being pulled through the door. Many conventional fastening arrangements utilize a bolt and a nut, or a bolt, nut and washer combination, to retain the security device against the interior of the cargo door. Since many conventional cargo doors consist essentially of a plywood or foam insulation "core" covered by an interior and an exterior thin metal "skin", the cargo door itself has limited resistance to "pull through." Thus, the combination of a limited area engaged by the security device fastener with the interior of the door and the limited resistance of the cargo door itself to "pull through," may allow the fastener to be pulled through the door, and the security device removed.

Some prior art security devices, for example U.S. Pat. No. 3,727,438 to Knaack and U.S. Pat. No. 4,745,783 to Poe include two corresponding security device members which are mounted on adjacent cargo doors. Thus, when the cargo doors are closed, the security device members are aligned and a padlock, or other locking mechanism is used to secure the security device members together. These types of security devices have several disadvantages. First, while it may be possible to maintain alignment between adjacent doors when the doors are relatively new, over time, doors tend to shift, warp, or otherwise become misaligned. Furthermore, since a security device member is mounted on each door, it is normally necessary to mark and make openings for the security device member fasteners through both doors. This not only results in more time being needed for installation of the security device, but also leaves openings through both doors if, at some future time, the security device members are removed from the doors.

U.S. Pat. No. 4,898,008 to Eberly discloses a padlock protector for swing-out type closures. However, such a padlock protector can be rendered inoperable by use of a hacksaw sawing through channel part 40 from below, thus, permitting horizontal lock arm to swing free. Another disadvantage of this type of padlock protector is that the shackle of the padlock has to be aligned and inserted through two holes, thus, causing engagement of the padlock to be more difficult and time consuming. Furthermore, by orientating the padlock body perpendicular to the rear door, the padlock protector extends a greater distance rearward away from the door. This not only causes an increase in the overall length of the truck, but also interferes with the swing-out doors from being positioned adjacent the trailer side walls when the trailer is being unloaded. This can cause damage to the doors or surrounding structure in tight loading/unloading docks, and in many cases, this extent of extension will preclude the door on which the padlock protector is mounted from being latched to the side wall of the trailer using the standard latching arrangement present on many commercial cargo trailers. In addition, it is difficult to concurrently use both a security seal and a lock with this device. Furthermore, the size of this type of padlock protector is often insufficient to cover preexisting openings through the cargo door, such as those present from mounting the original equipment security device, or other prior security device. Such uncovered openings allow dirt, moisture and other debris to enter into the internal cargo carrying space, and also cause energy losses in temperature or environmentally controlled cargo carrying space, for example refrigerated trailers.

Accordingly, an object of the present invention is the provision of security devices for cargo doors and similar articles which may be readily mounted on the conventional double doors present on many cargo carrying vehicles and used to secure such conventional double doors to preclude unauthorized access to the contents of the cargo carrying vehicles.

Another object of the present invention is to provide security devices for cargo doors and similar articles which include a minimum number of separate components readily fabricated utilizing conventional manufacturing processes.

A further object of the present invention is to provide security devices for cargo doors and similar articles which utilize conventional padlocks and include shackle protection to deter unauthorized removal of the padlock.

A still further object of the present invention is to provide security devices for cargo doors and similar articles which permit the concurrent use of a security seal and a padlock, or some other locking mechanism.

Still a further object of the present invention is to provide security devices for cargo doors and similar articles which cover preexisting openings through the cargo doors, such as those present from mounting the original equipment security device, or other prior security device.

Yet another object of the present invention is to provide security devices for cargo doors and similar articles which are secured to the cargo doors by a fastening arrangement which does not substantially extend beyond the interior of the cargo doors into the cargo carrying space.

Yet still another object of the present invention is to provide security devices for cargo doors and similar articles which allow rapid engagement and disengagement using a conventional padlock.

These and other objects of the present invention are attained by the provision of a security device for cargo doors and similar articles which utilizes a conventional padlock to secure the horizontally extending handle present on many conventional double cargo doors of cargo carrying vehicles. The security device includes a stationary base member which is mounted on the cargo door by carriage bolts or other conventional fasteners and a blocking member which is rotatably mounted on the cargo door above the stationary base member. The rotatable blocking member can be rotated in a plane parallel to the cargo door upwardly in relation to the stationary base member to allow the horizontally extending handle to be placed adjacent the stationary base member. Once the horizontally extending handle is placed in this position, the rotatable blocking member is rotated to a position adjacent the stationary base member and a conventional padlock is used to lock rotatable blocking member and stationary base member together thereby securing the horizontally extending handle between the cargo door and the security device. Thus, further movement of the horizontally extending handle is precluded until the padlock is removed and the rotatable blocking member pivoted to a position away from the stationary base member.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
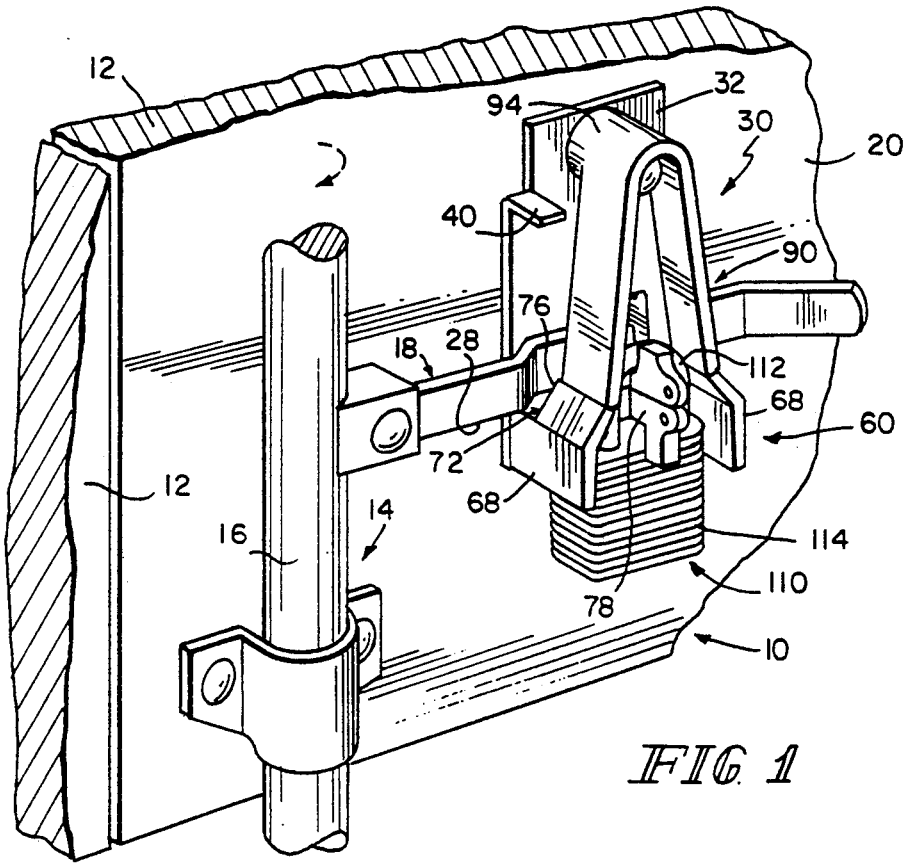
FIG. 1, which illustrates a preferred embodiment of a security device for cargo doors and similar articles, shows a perspective view of the security device mounted on conventional double doors of a cargo carrying vehicle.

Referring now to the drawings, in which like referenced characters indicate corresponding elements throughout the several views, attention is directed to. FIGS. 1 through 5 which illustrate a preferred embodiment of a security device for cargo doors and similar articles, designated generally by the numeral 30. Security device 30 is shown mounted on cargo carrying vehicle 10 of conventional design having a pair of swing-out type doors 12 which enclose a cargo bay (not shown). Swing-out type door 12 includes locking mechanism 14 generally including vertically extending locking member 16 and horizontally extending handle 18 pivotally attached to vertically extending locking member 16. Vertically extending locking member 16 includes a locking element or cam (not shown) which engages with a corresponding slot or keeper (not shown) mounted on the frame (not shown) of cargo carrying vehicle 10 when swing-out type doors 12 are in their closed position. Thus, when horizontally extending handle 18 is in a plane parallel to swing-out type door 12, cam (not shown) of vertically extending locking member 16 engages with keeper (not shown) and swing-out type door 12 is locked in a closed position. As horizontally extending handle 18 is rotated to a position substantially perpendicular to swing-out type door 12, cam (not shown) of vertically extending locking member 16 disengages from keeper (not shown) and swing-out type door 12 is unlocked, thus, permitting swing-out type door 12 to be opened. Locking mechanism 14 is of conventional design and accordingly its configuration and operation will not be described in further detail here.

Figure 2:
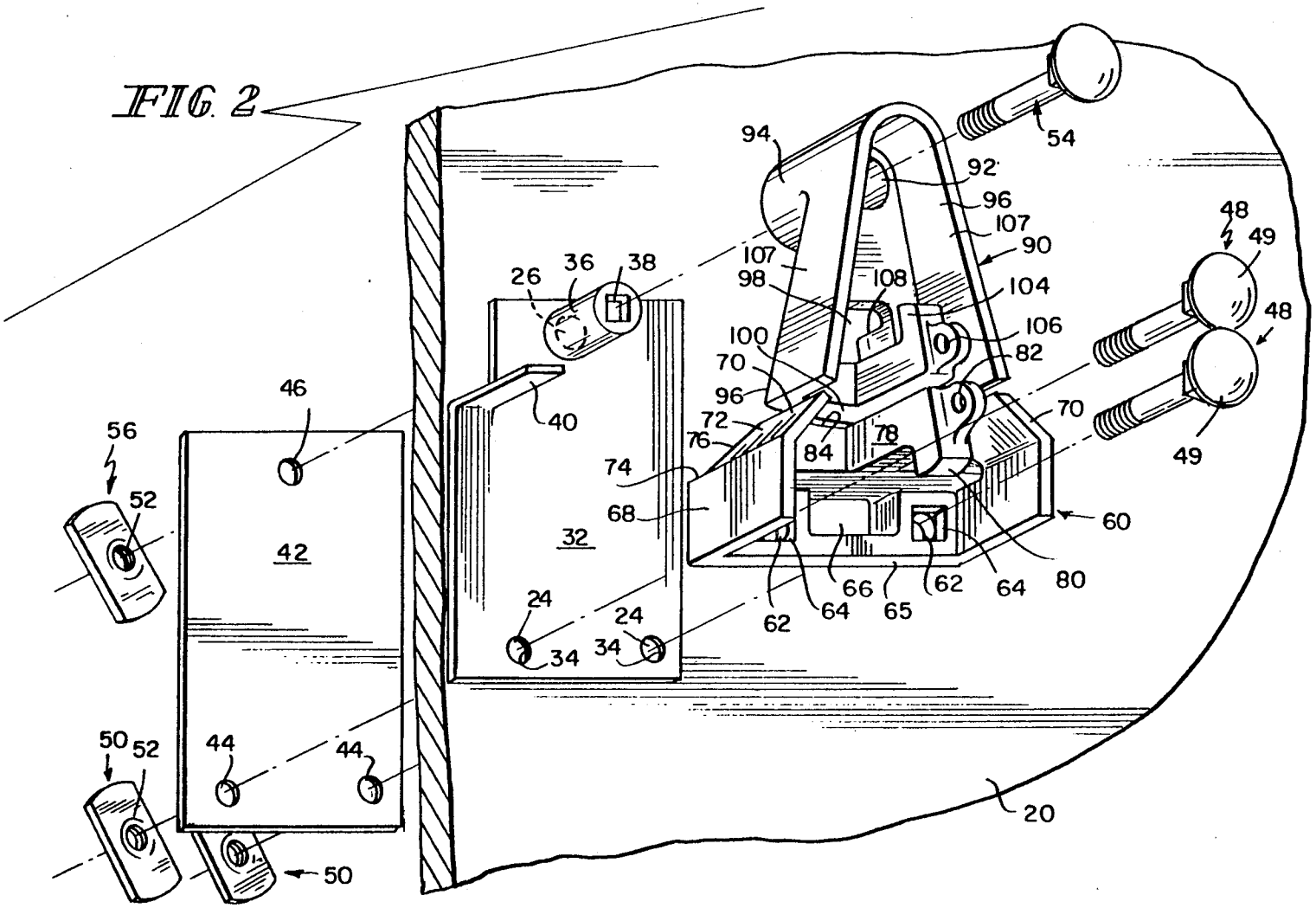
FIG. 2 is an exploded perspective view of the security device for cargo doors and similar.articles shown in FIG. 1.
Figure 4:
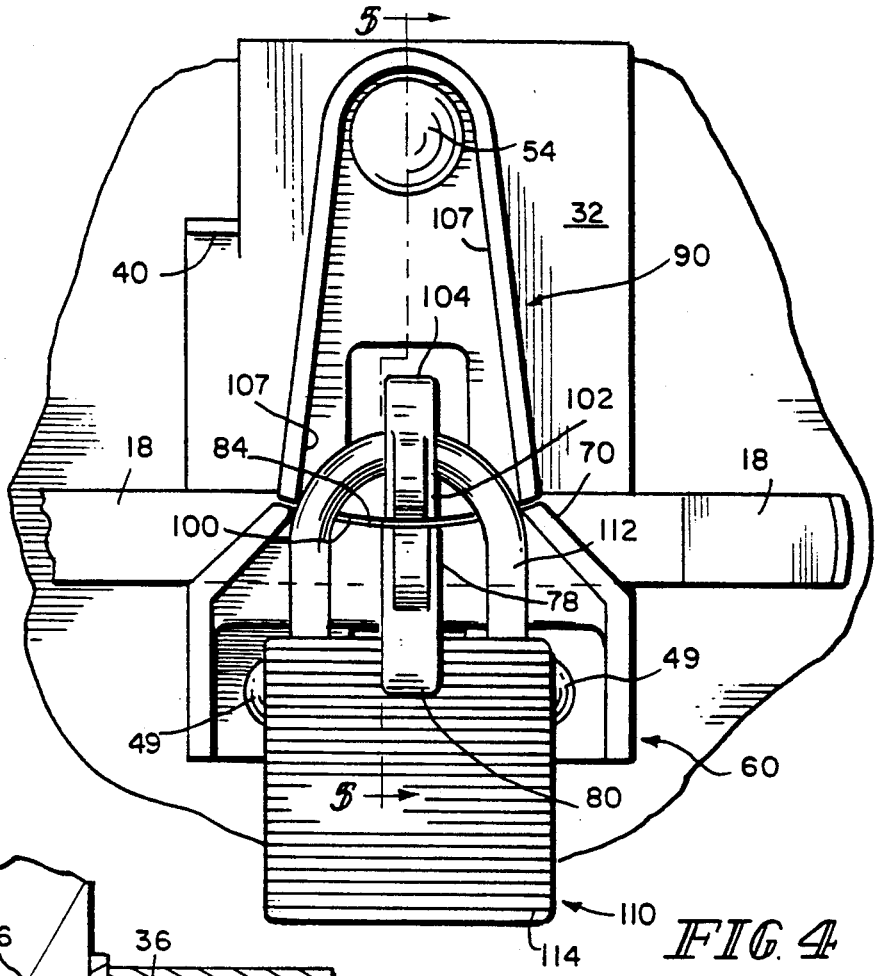
FIG. 4 is a front view of the security device for cargo doors and similar articles with the blocking member secured in a position adjacent to the stationary base member with a padlock and the horizontally extending handle held in position behind the security device.
Figure 5:
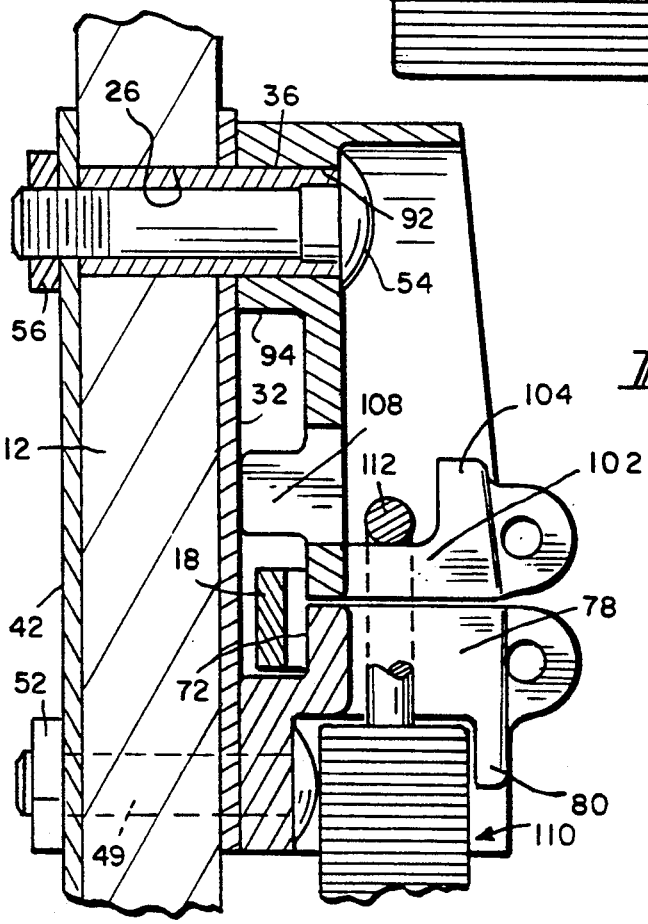
FIG. 5 is a cross-sectional view of the security device for cargo doors and similar articles shown in FIG. 1 taken across line 5—5 of FIG. 4.

Security device 30 generally consists of exterior plate 32, interior plate 42, stationary base member 60 and rotatable blocking member 90. These elements are mounted at a level corresponding to horizontally extending handle 18 on swing-out type door 12. As seen in FIG. 2, exterior plate 32 and interior plate 42 are used to mount stationary base member 60 and rotatable blocking member 90 on exterior surface 20 of swing-out type door 12. Exterior plate 32 and interior plate 42 are preferably generally rectangular in configuration and are fabricated from $\frac{1}{8}''$ thick steel plate. Furthermore, exterior plate 32 and interior plate 42 are preferably sufficiently large to cover any holes which may be pre-existing on swing-out cargo door 12. Stationary member 60 preferably includes two openings 62 which are aligned with openings 34 in exterior plate 32 and openings 44 in interior plate 42. Stationary member 60 is secured to exterior surface 20 of swing-out type door 12 by means of carriage bolts 48 or some other conventional fasteners which pass through openings 62 in stationary base member 60, openings 34 in exterior plate 32, openings 24 in swing-out type door 12 and openings 44 in interior plate 42. Carriage bolts 48 preferably do not extend appreciably beyond the interior surface of swing-out type door 12 and are secured in position by weld nuts 50 or other conventional retaining mechanism positioned adjacent interior plate 42. Carriage bolts 48 are preferably retained within recesses or counterbores 64 in stationary base member 60 and include head portion 49 which is not readily accessible with conventional tools to preclude potential removal by unauthorized individuals from the exterior of swing-out cargo door 12. The use of weld nuts 50 allow threads on carriage bolts 48 to be engaged within swing-out type door 12. In the preferred embodiment shown carriage bolts 48 are $1\frac{3}{4}'' \times \frac{1}{2}''$ #5 carriage bolts with epoxy lock and weld nuts 50 are $\frac{1}{2}''$ #8 weld nuts. However, it will be readily recognized by those skilled in the relevant art that other fasteners and fastening arrangements may be used to securely mount stationary base member 60 to exterior surface 20 of swing-out type door 12. Furthermore, while not necessary on some swing-out type doors 12, exterior plate 32 and interior plate 42 provide reinforcement and help avoid pull through of the fasteners, particularly when security device 30 is mounted on swing-out type doors 12 fabricated from a relatively thin metal "skin" and using a low strength lightweight material as a filler, such as plywood or, in many commercial refrigerated trailers, foam insulation.

Lower portion 65 of stationary base member 60 preferably mounts on exterior plate 32 flush with exterior surface 20 of swing-out type door 12 to allow stationary base member 60 to be securely mounted thereto by carriage bolts 48 or other conventional fasteners as previously described. Opening 66 is present in lower portion 65 to reduce the weight and mass of material needed to fabricate stationary base member 60 and also allows downwardly extending projection 80 to be formed as cast if stationary base member 60 is fabricated from a casting. Lower portion 65 transitions to offset portion 72, including horizontal surface 74 and vertical wall 76. Offset portion 72 provides a cavity for placement of horizontally extending handle 18 as will be subsequently described. Outer sidewalls 68 of lower portion 65 preferably extend upwardly and transition to inwardly angled sidewalls 70 through offset portion 72. Top surface 84 of stationary base member 60 is preferably radiused to correspond with bottom surface 100 of rotatable blocking member 90 as will be subsequently described. Outwardly extending arm 78 extends from offset portion 72 away from swing-out type door 12 and includes downwardly extending projection 80 which positions lock body 114 of padlock 110 therein. Opening 82 positioned on the outer portion of outwardly extending arm 78 provides a convenient location to place security seal 86 on security device 30 if desired. Stationary base member 60 is preferably fabricated as a casting from a high grade 80-55-06 perlite ductile iron material which preferably has been annealed. However, it will be recognized by those with skill in the relevant art that other suitable materials may be used.

Rotatable blocking member 90 includes opening 92 which is slightly larger and rotatably mates with projection 36 extending outwardly away from exterior plate 32. Rotatable blocking member 90 is secured in position by carriage bolt 54 or some other conventional fastener extending through opening 92 in rotatable blocking member 90, opening 38 in projection 36 on exterior plate 32, opening 26 in swing-out type door 12, opening 46 in interior plate 42 such that carriage bold 54 bottoms out on projection 36. This permits rotatable blocking member 90 to freely rotate while carriage bolt 54 is securely engaged with weld nut 56. Carriage bold 54 preferably does not extend appreciably beyond the interior surface of swing-out type door 12 and is secured in position by weld nut 56 or some other conventional retaining arrangement. The use of weld nut 56 allows the threads on carriage bolt 54 to be engaged within swing-out type door 12. Carriage bolt 54 is preferably a $2\frac{1}{2}'' \times \frac{1}{2}''$ #5 carriage bolt with epoxy lock and weld nut 56 is preferably a $\frac{1}{2}''$ #8 weld nut, although it will be recognized by those skilled in the relevant art that other suitable fastening arrangements could readily be utilized.

Rotatable blocking member 90 includes a rearwardly extending collar 94 surrounding opening 92 which positions rotatable blocking member 90 spaced by a predetermined distance from swing-out type door 12. Bottom surface 100 of rotatable blocking member 90 is radiused to correspond with top surface 84 of stationary base member 60. Rotatable blocking member 90 includes outwardly extending arm 102 having upwardly extending projection 104 to receive and position shackle 112 of padlock 110. Outwardly extending arm 78 of stationary base member 60 and outwardly extending arm 102 of rotatable blocking member 90 correspond to be retained by lock body 114 and shackle 112 of padlock 110 when shackle 112 is retained in lock body 114. Outwardly extending wall 107 encloses rotatable blocking member 90 along inwardly angled side walls 96 to shield shackle 112 of padlock 110 from unauthorized disengagement by hammers, bolt cutters, pry bars, hacksaws and other tampering devices. Furthermore, by positioning lock body 114 adjacent to stationary base member 60, hammering on padlock 110 is discouraged and to a large extent rendered ineffective since padlock 110 is backed up by stationary base member 60 and swing-out type door 12. If desired, opening 98 in rotatable blocking member 90 can reduce the material needed to fabricate and the overall weight of rotatable blocking member 90 and also allows upwardly extending projection 104 to be formed as cast if rotatable blocking member 90 is fabricated from a casting. Opening 106 extending outwardly from outwardly extending arm 102 of rotatable blocking member 90 permits use of security seal 86, if desired, between opening 106 of rotatable blocking member 90 and opening 82 of stationary base member 60.

Rotatable blocking member 90 also includes rearwardly extending projection 108 which when rotatable block member 90 is in position adjacent stationary base member 60 precludes upward movement of horizontally extending handle 18. Thus, when in the locked position, horizontally extending handle 18 is retained between offset portion 72 of stationary base member 60 and rearwardly extending projection 108 of rotatable blocking member 90. Stationary base member 60 and rotatable blocking member 90 are retained in this position by securing outwardly extending arm 78 of stationary base member 60 and outwardly extending arm 102 of rotatable blocking member 90 between shackle 112 and lock body 114 of padlock 110 when shackle 112 is engaged with lock body 114 over outwardly extending arm 78 of stationary base member 60 and outwardly extending arm 102 of rotatable blocking member 90. When rotatable blocking member 90 is rotated upwardly over center, tab 40 extending outwardly from exterior plate 32 holds rotatable blocking member 90 in this disengaged position allowing entry and removal of horizontally extending handle 18. Rotatable blocking member 90 is preferably fabricated as a casting from a high grade 80-55-06 perlite ductile iron material which preferably has been annealed. However, it will be recognized by those with skill in the relevant art that other suitable materials may be used. Furthermore, it is anticipated that padlock 110 could be key actuated or a combination type lock as preferred by the user.

In order to install security device 20 on swing-out type door 12, exterior plate 32 can be used as a template to locate where to drill three $\frac{1}{2}''$ diameter holes through swing-out type door 12. Security device 30 should be positioned such that bottom surface 28 of horizontally extending handle 18 is just above offset portion 72 in stationary base member 60. After drilling three $\frac{1}{2}''$ diameter holes at the appropriate locations, carriage bolts 48 are inserted through openings 62 in stationary base member 60, openings 34 in exterior plate 32, openings 24 in swing-out type door 12 and openings 44 in interior plate 42. Weld nuts 50 are then threaded onto carriage bolts 48 with protrusion 52 extending into openings 44 in interior plate 42 and tightened. Next, opening 92 in rotatable blocking member 90 is positioned over opening 38 in projection 36 extending from exterior plate 32 and carriage bolt 54 is inserted through opening 92 in rotatable blocking member 90, opening 38 in projection 36 extending from exterior plate 32, opening 26 in swing-out type door 12 and opening 46 in interior plate 42. Weld nut 56 is then threaded onto carriage bolt 54 with protrusion 58 extending into opening 46 in interior plate 42 and tightened. If desired, weld nut 56 could be welded to carriage bolt 54 to further deter unauthorized removal of security device 20.

Figure 3:
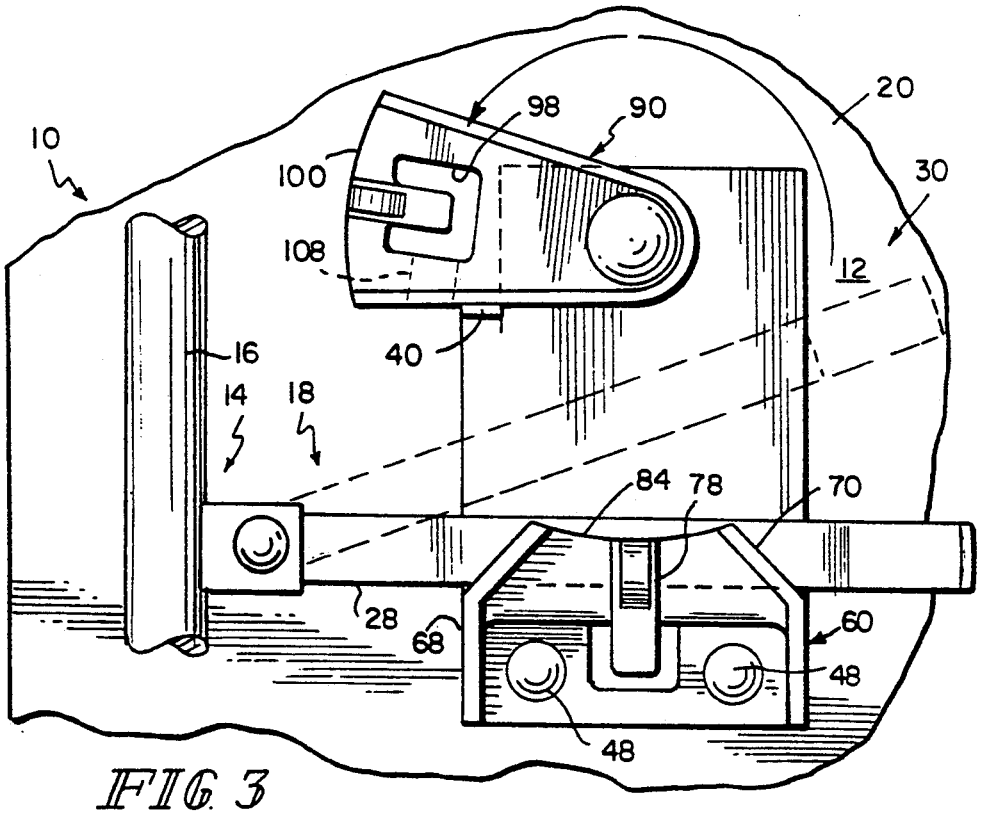
FIG. 3 is a front view of the security device for cargo doors and similar articles with the padlock removed and the blocking member rotated to a position away from the stationary base member to permit entry of the horizontally extending handle.

To secure swing-out type door 12 using security device 30, rotatable blocking member 90 is pivoted upwardly as indicated by the arrows in FIG. 3 over center such that rotatable blocking member 90 rests upon tab 40 extending outwardly from exterior plate 32. Horizontally extending handle 18 is then pivoted to rest on offset portion 72 of stationary base member 60. At this time, rotatable blocking member 90 is pivoted over center and moved to a position adjacent stationary base member 60, thus, trapping horizontally extending handle 18 therebetween. If necessary, shackle 112 of padlock 110 is released from lock body 114 and shackle 112 is placed behind upwardly extending projection 104 and over outwardly extending arm 102 of rotatable blocking member 90. Without pivoting shackle 112 in relation to lock body 114, lock body 114 can be swung into position behind downwardly extending projection 80 and below outwardly extending arm 78 of stationary base member 60. In this position, lock body 114 is moved upward relative to shackle 112 until shackle 112 engages within lock body 114, thus, locking padlock 110 and securing horizontally extending handle 18 behind stationary base member 60 and rotatable blocking member 90.

To remove security device 30 and open swing-out type door 12, the steps described above are reversed. Shackle 112 is disengaged from lock body 114 by means of a key or other implement (not shown) or by using the proper disengaging combination in the case of a combination padlock. Lock body 114 is then swung outwardly away from swing-out type door 12 to clear downwardly extending projection 80 and padlock 110 is lifted upwardly as a unit to clear upwardly extending projection 104. Once padlock 110 is removed, rotatable blocking member 90 is rotated upward over center such that projection 108 of rotatable blocking member 90 rests upon tab 40 outwardly extending from exterior plate 42. At this time, horizontally extending handle 18 is rotated upwardly to clear stationary base member 60 and swung outwardly to disengage locking mechanism 14 of swing-out type door 12. To minimize the possibility of misplacing padlock 110 while security device 30 is disengaged, rotatable blocking member 90 may be rotated back over center to a position adjacent stationary base member 60 and padlock 110 secured thereon as previously described.

From the preceding description of the preferred embodiment, it is evident that the objects of the invention are attained by the present invention. Although this invention has been described and illustrated in detail, it is to be clearly understood that the same is by way of illustration and example only and is not to be taken by way of limitation. For example, security device 30 could be adapted for use on other type of doors, including doors that roll or slide into their closed position, or doors that have handles which move in a horizontal plane. Therefore, the spirit and scope of this invention are to be limited only by the terms of the appended claims.

What is claimed is:

1. A security device for a cargo door, said cargo door having a locking mechanism with a handle, comprising:

a stationary base member having a radiused top surface, an arm extending outward from said stationary base member and a projection extending downward from said arm;

a rotatable blocking member having a radiused bottom surface, an arm extending outward from said rotatable blocking member and a projection extending upward from said arm;

said stationary base member and said rotatable blocking member including blocking means for retaining said handle between said cargo door and said stationary base member and said rotatable blocking member when said radiused bottom surface of said rotatable blocking member is positioned adjacent said radiused top surface of said stationary base member; and locking means for retaining said radiused bottom surface of said rotatable blocking member in position adjacent to said radiused top surface of said stationary base member.

2. The security device for a cargo door according to claim 1, wherein said locking means for securing said radiused bottom surface of said rotatable blocking member in position adjacent to said radiused top surface of said stationary base member is a conventional padlock.

3. The security device for a cargo door according to claim 2, wherein said conventional padlock has a shackle and at least one of said rotatable blocking member and said stationary base member has an outwardly extending wall which shields said shackle of said padlock.

4. The security device for a cargo door accordingly to claim 2, wherein said conventional padlock has a shackle and said rotatable blocking member and said stationary base member each have outwardly extending walls which shield said shackle of said padlock.

5. The security device of claim 4, wherein said conventional padlock has a lock body, said shackle of said conventional padlock is positioned over said outwardly extending arm and behind said downwardly extending projection of said stationary base member and said lock body of said conventional padlock is positioned under said outwardly extending arm and behind said upwardly extending projection of said rotatable blocking member to secure said radiused bottom surface of said rotatable blocking member in position adjacent to said radiused top surface of said stationary base member.

6. The security device of claim 1 further including an interior plate and an exterior plate for mounting said security device to said cargo door.

7. The security device of claim 5, wherein said rotatable blocking member has an inwardly extending collar, said exterior plate has an outwardly extending projection and said inwardly extending collar of said rotatable blocking member surrounds and is rotatably mounted in relation to said outwardly extending projection of said exterior plate.

8. A security device for a cargo door, said cargo dooring having a locking mechanism with a handle, comprising a stationary base member having an arm extending outward from said stationary base member and a projection extending downward from said arm;

a rotatable blocking member having an arm extending outward from said rotatable blocking member and a projection extending upward from said arm;

said stationary base member and said rotatable blocking member including blocking means for retaining said handle between said cargo door and said stationary base member and said rotatable blocking member when said rotatable blocking member is positioned adjacent said stationary base member; and locking means engaging said outwardly extending arm of said rotatable blocking member behind said upwardly extending arm and said outwardly extending arm of said stationary base member behind said downwardly extending arm for retaining said rotatable blocking member in position adjacent to said stationary base member.

9. The security device for a cargo door according to claim 8, wherein said locking means for securing said radiused bottom surface of said rotatable blocking member in position adjacent to said radiused top surface of said stationary base member is a conventional padlock.

10. The security device for a cargo door according to claim 9, wherein said conventional padlock has a shackle and said rotatable blocking member and said stationary base member each have outwardly extending walls which shield said shackle of said padlock.

11. The security device of claim 10 further including an interior plate and an exterior plate for mounting said security device to said cargo door.

12. The security device of claim 11, wherein said rotatable blocking member has an inwardly extending collar, said exterior plate has an outwardly extending projection and said inwardly extending collar of said rotatable blocking member surrounds and is rotatably mounted in relation to said outwardly extending projection.

13. A security device for a cargo door for use in conjunction with a conventional padlock having a shackle and a lock body, said cargo door having a locking mechanism with a handle, comprising:

a stationary base member having an arm extending outwardly from said stationary base member, a projection extending downward from said arm and shielding means extending outward from said stationary base member for precluding access to said shackle of said padlock;

a rotatable blocking member having an arm extending outward from said rotatable blocking member, a projection extending upward from said arm and shielding means extending outward from said rotatable blocking member for precluding access to said shackle of said padlock;

said stationary base member and said rotatable blocking member including blocking means for retaining said handle between said cargo door and said stationary base member and said rotatable blocking member when said rotatable blocking member is positioned adjacent said stationary base member; and said shackle of said conventional padlock is positioned over said outwardly extending arm of said rotatable blocking member behind said upwardly extending projection and said lock body of said conventional padlock is positioned under said outwardly extending arm of said stationary base member behind said downwardly extending projection to retain said rotatable blocking member in position adjacent to said stationary base member.

14. The security device for a cargo door according to claim 13, wherein said shackle of said conventional padlock is substantially parallel to said cargo door when said conventional padlock is engaged with said security device.

15. The security device of claim 14 further including an interior plate and an exterior plate for mounting said security device to said cargo door.

16. The security device of claim 15, wherein said rotatable blocking member has an inwardly extending collar, said exterior plate has an outwardly extending projection and said inwardly extending collar of said rotatable blocking member surrounds and is rotatably mounted in relation to said outwardly extending projection of said exterior plate.

* * * * *